US009410406B2

(12) United States Patent
Yuan

(10) Patent No.: US 9,410,406 B2
(45) Date of Patent: Aug. 9, 2016

(54) TARGETED ORIENTED FRACTURE PLACEMENT USING TWO ADJACENT WELLS IN SUBTERRANEAN POROUS FORMATIONS

(71) Applicant: BitCan Geosciences & Engineering Inc., Calgary (CA)

(72) Inventor: Yanguang Yuan, Calgary (CA)

(73) Assignee: BITCAN GEOSCIENCES & ENGINEERING INC., Calgary, Alberta (CA)

( * ) Notice: Subject to any disclaimer, the term of this patent is extended or adjusted under 35 U.S.C. 154(b) by 313 days.

(21) Appl. No.: 13/967,005

(22) Filed: Aug. 14, 2013

(65) Prior Publication Data

US 2015/0047832 A1 Feb. 19, 2015

(51) Int. Cl.
*E21B 43/17* (2006.01)
*E21B 43/26* (2006.01)

(52) U.S. Cl.
CPC ..... *E21B 43/17* (2013.01); *E21B 43/26* (2013.01)

(58) Field of Classification Search
CPC ..... E21B 43/17; E21B 43/2405
See application file for complete search history.

(56) References Cited

U.S. PATENT DOCUMENTS

| | | | | |
|---|---|---|---|---|
| 3,058,730 | A | | 10/1962 | Bays |
| 3,501,201 | A | | 3/1970 | Closmann et al. |
| 3,593,791 | A | | 7/1971 | Parker |
| 3,613,785 | A | | 10/1971 | Closmann et al. |
| 3,706,341 | A | | 12/1972 | Redford |
| 3,709,295 | A | | 1/1973 | Braunlich, Jr. et al. |
| 3,779,601 | A | * | 12/1973 | Beard ..... E21B 43/281 166/271 |
| 3,965,982 | A | | 6/1976 | Medlin |
| 4,005,750 | A | | 2/1977 | Shuck |
| 4,612,989 | A | * | 9/1986 | Rakach ..... E21B 43/2405 166/263 |
| 4,683,950 | A | * | 8/1987 | Lessi ..... E21B 43/17 166/271 |
| 4,733,726 | A | | 3/1988 | Alameddine et al. |
| 4,754,808 | A | | 7/1988 | Harmon et al. |
| 4,830,106 | A | | 5/1989 | Uhri |
| 4,889,186 | A | | 12/1989 | Hanson et al. |
| 5,025,859 | A | | 6/1991 | Hanson et al. |
| 6,012,520 | A | | 1/2000 | Yu et al. |
| 7,104,320 | B2 | | 9/2006 | Buchanan et al. |

(Continued)

FOREIGN PATENT DOCUMENTS

| | | |
|---|---|---|
| CA | 1235652 | 4/1988 |
| CA | 1286217 | 7/1991 |
| CA | 1323561 | 10/1993 |

(Continued)

OTHER PUBLICATIONS

Bouteca, M., Lessi, J. Sarda, J.P., Stress Changes Induced by Fluid Injection in a Porous Layer Around a Wellbore, Communication Presented on Behalf of the Technical Committee of Group D'Etude de la Gazeificaton Souterraine du Charbon (G.E.G.S.), Jun. 1983, pp. 99 to 106.

(Continued)

*Primary Examiner* — Giovanna C Wright
(74) *Attorney, Agent, or Firm* — Field LLP

(57) ABSTRACT

A method is taught of creating one or more targeted fractures in a subterranean formation. The method comprises the steps of drilling and completing two wells in the formation, conditioning said wells to create a stress condition favorable for forming a fracture zone connecting said two wells and initiating and propagating the fracture zone in said formation.

30 Claims, 9 Drawing Sheets

(56) References Cited

U.S. PATENT DOCUMENTS

| | | | | |
|---|---|---|---|---|
| 2006/2136580 | | 9/2006 | Nishimura | |
| 2014/0246194 | A1* | 9/2014 | Artus | E21B 43/26 166/271 |

FOREIGN PATENT DOCUMENTS

| | | |
|---|---|---|
| CA | 2611928 | 12/2006 |
| CA | 2663823 | 4/2008 |
| RU | 2176021 | 11/2001 |

OTHER PUBLICATIONS

Gadelle, C. Lessi, J. Sarda, J.P., Underground Coal Gasification at Great Depth: The French Field Test of Bruay-en-Artois, Conference paper, date unknown, France.

* cited by examiner $t = t_0$, $\sigma_2 > \sigma_{min}$

TARGETED ORIENTED FRACTURE PLACEMENT USING TWO ADJACENT WELLS IN SUBTERRANEAN POROUS FORMATIONS

FIELD OF THE INVENTION

The present invention relates to a method of inducing targeted oriented fractures connecting two wells drilled in subterranean porous formations whether or not the connection of the two wells is oriented perpendicular to the in-situ minimum stress.

BACKGROUND

In many Earth engineering applications, wells are drilled into subterranean porous formations. It is desirable to create a fracture connecting two neighboring wells. In general, the fracture follows the plane perpendicular to the least resistance, i.e., perpendicular to the original in-situ minimum stress, Smin. Thus, normally, the two wells need to be drilled so that the line connecting them is aligned perpendicular to Smin. Otherwise, if the two wells are drilled substantially deviated from the preferred direction, a fracture may not be formed to connect the two wells. In Canada and many parts of the world, petrochemicals are found in heavy, viscous forms such as bitumen, which are difficult to extract. The bitumen-saturated oilsands reservoirs of Canada, Venezuela and California are just some examples of such subterranean formations. In these formations, it is not possible to simply drill wells and pump out the oil. Instead, the reservoirs are heated or otherwise stimulated to reduce viscosity and promote extraction.

The two most common and commercially-proven methods of stimulating oilsands reservoirs are (a) cyclic steam stimulation (CSS) and (b) steam assisted gravity drainage (SAGD). In both cases, steam is injected into the reservoir, to heat up the bitumen. Some variations of these processes may involve injecting solvent to aid the viscosity reduction or use electrical heating to replace the role of steam. In general, the initial injectivity into the reservoir, i.e., how much volume of the stimulant can be injected per unit of time, is relatively small. Fracturing of the reservoir is desired to provide channels for the stimulant travel and to access the reservoir. The fracture not only increases the injectivity, but also increases the contact area of the stimulant within the reservoir. For example, in CSS, the injection pressure goes above the reservoir's fracture pressure with the goal to form the fracture. It is desirable to be able to control the orientation, depth and length of fractures in the reservoir, in order to more effectively place stimulant in the targeted location, extent and/or time, all of which can help maximize petroleum extraction.

In the SAGD process, before the production can start, communication between the SAGD well pair must be established so that the bitumen can flow down to the production well. Conventionally, steam is circulated through the said two wells independently until the inter-well area is heated and the bitumen viscosity is reduced significantly so that it can flow to the production well and communication is established. This process normally takes up to 6 months to complete. Such a non-productive period wastes steam and manpower, ties up the capital used to build the infrastructure. If the SAGD wells can be hydraulically fractured, forming a high-mobility conduit connecting the two SAGD wells, the inter-well communication can occur much earlier and stronger.

The art of hydraulic fracturing as a stimulation method for hydrocarbon resource recovery has been practiced for a long time. In general, this method injects liquid at a high pressure into a well drilled through the target formation to be stimulated. The high pressure initiates a fracture from the injection well and propagates a sufficient distance into the formation. Then, the fracture is filled with proppants that are injected from the surface after the fracture is formed. The similar method is applied in vertical and horizontal wells and wells of any inclinations. However, the existing art of hydraulic fracturing is subject to limitations.

In hydraulic fracturing, there has historically been no proactive control of the orientation of the fracture formed. The fracture typically follows the plane perpendicular to the least resistance, i.e., perpendicular to the original in-situ minimum stress, $S_{min}$. In many situations, SAGD wells may not be drilled in this optimal direction. For example, the azimuth of the SAGD wells being drilled might be dictated by the deposit channel of the oilsands resource. The well pair then tends to follow the channel direction which may or may not coincide with the $S_{min}$ direction. If a horizontal well is drilled in the direction of the minimum stress $S_{min}$ or substantially inclined towards it, the fracture being formed via the conventional hydraulic fracturing may be discrete in the vertical cross-section perpendicular or substantially perpendicular to the horizontal well. Such fractures may not be ideal for the petroleum production. For example, discrete fractures perpendicular to the SAGD wells do not contribute to uniform communication between the well pair.

There has been some work done in controlling the orientation of fractures including selective placement of hydraulically-driven fractures in the plane perpendicular to the original in-situ maximum stress, Smax. These practices in the past, however, typically require a sacrificial well which was fractured first along the direction perpendicular to Smin, i.e., the original in-situ stress condition dictates the fracture formed on this sacrificial well. For example, U.S. Pat. No. 3,613,785 by Closmann (1971) teaches creating a horizontal fracture from a first well by vertically fracturing the formation from a second well and then injecting hot fluid to heat the formation. Heating via the vertical fracture alters the original in-situ stress so that the vertical stresses become smaller than horizontal stresses, thus favouring a horizontal fracture being formed. This method requires a first sacrificial vertical fracture be formed and uses costly steam to heat the formation.

U.S. Pat. No. 3,709,295 by Braunlich and Bishop (1971) controlled the direction of hydraulic fractures by employing at least three wells and a natural fracture system. This method is only feasible in formations already having existing fractures.

U.S. Pat. No. 4,005,750 by Shuck (1975) teaches creating an oriented fracture in the direction of the minimum in-situ stress from a first well by first hydraulically fracturing another well to condition the formation. Again, additional wells and sacrificial fractures are required before the targeted fracture can be formed.

Canadian patent CA 1,323,561 by Kry (1985) teaches creating a horizontal fracture from a center well after cyclically steam-stimulating at least one peripheral well. At the peripheral well a vertical fracture is created. CSS operations coupled with fracturing at the peripheral well conditions the stress field so that a horizontal fracture can be formed. To create the horizontal fracture, a high-viscosity fluid is proposed to inject into the center well to limit the fluid from leaking into the formation.

Canadian patent CA 1,235,652 by Harding et al. (1988) first vertically-fractures the formation from peripheral wells to alter or condition the in-situ stress regime in the center region of the peripheral wells. The formation is then fractured through a central well to create and extend a horizontal fracture.

All of the above documents require either the existence of a natural fracture in the formation already or the formation of sacrificial fractures before a targeted fracture can be induced. This pre-condition adds cost to well drilling and completion.

The idea of forming a target fracture without initiating sacrificial fractures has been proposed in two presentation papers by Lessi, J., et al. . ("Underground Coal Gasification at Great Depth"; Technical Committee of Groupe d'Etude de la Gazefication Souterraine du Charbon and "Stress Changes Induced by Fluid Injection in a Porous Layer Around a Wellbore"; 24$^{th}$ US Symposium on Rock Mechanics June 1983). These papers propose drilling two wells and forming a fracture connecting them even though their connection line may be not oriented perpendicular to Smin. According to the authors, this process relies on pressure diffusion and thus-associated poroelastic stress to create a fracture between the two wells. The two papers did not address interaction between the wells.

It is therefore of great interest to find a new method to overcome the original in-situ stress condition for selective placement of a fracture without drilling a sacrificial well or dictating presence of natural fractures.

SUMMARY OF THE INVENTION

A method is taught of creating one or more targeted fractures in a subterranean formation. The method comprises the steps of drilling and completing two wells in the formation, conditioning said wells to create a stress condition favorable for forming a fracture zone -connecting said two wells and initiating and propagating the fracture zone in said formation.

DESCRIPTION OF THE DRAWINGS

The invention will now be described in further detail with reference to the following drawings, in which.

DETAILED DESCRIPTION OF THE PREFERRED EMBODIMENTS

The present invention provides a method of controlling the orientation of fractures in subterranean porous formations.

More specifically, the present invention provides a method of forming a fracture connecting two wells in subterranean geological formations even though the connection of the said wells is not oriented perpendicular to the original in-situ minimum stress. The said fracture(s) will facilitate the communication between the said wells. One direct application is to facilitate early and uniform start-up of the SAGD process in the in-situ recovery of heavy oil/oilsands reservoirs.

The orientation of the fracture(s) in subterranean formations is typically dependant on the in situ stresses at a particular location in the formation. Generally, fractures form in a direction perpendicular to the direction of the least stress.

However, the present inventors have found that the original in situ stress profile can be modified via interaction of said two wells in the pressure and/or temperature diffusion, and thereby change the orientation of induced fractures to the direction connecting the said two wells. The present method does not require one or more sacrificial fractures being formed a prior to preconditioning. Furthermore, it does not depend whether or not the original in-situ stress field favors the formation of the target fracture.

Figure 4:
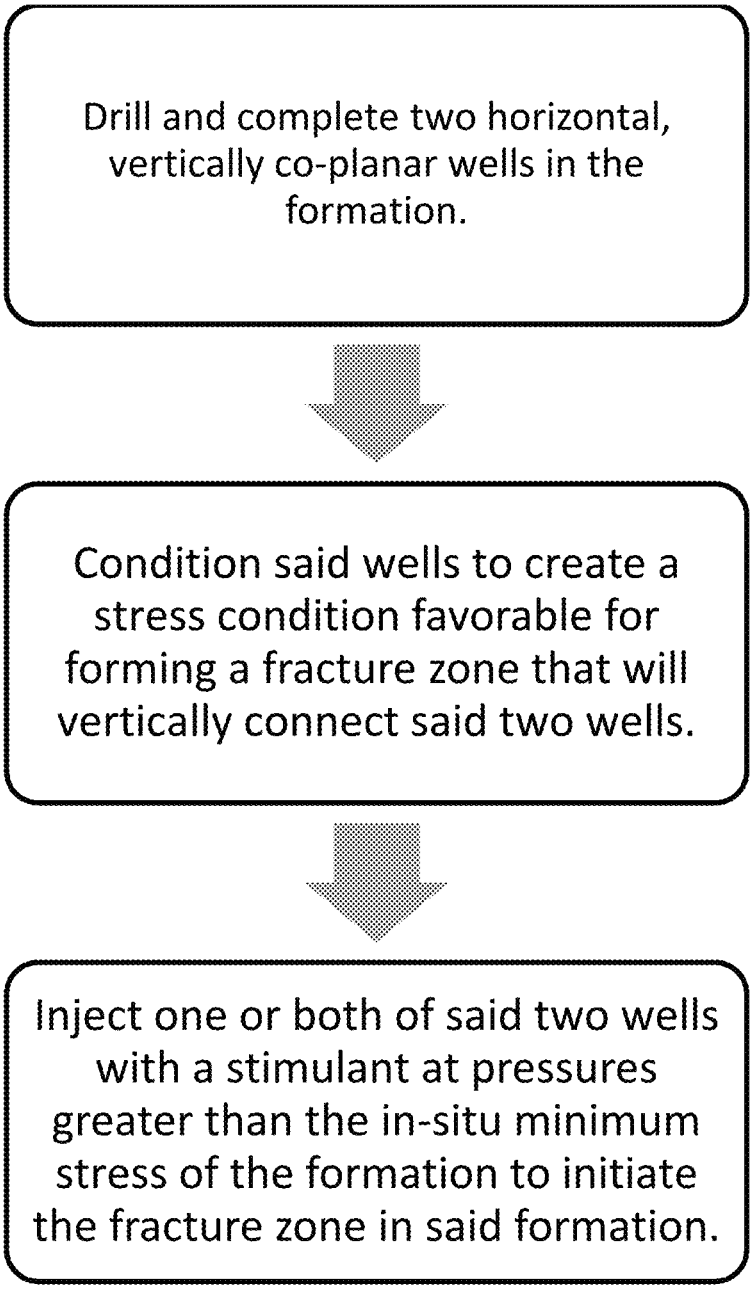
FIG. 4 is a schematic diagram of one embodiment of a method of the present invention.

The process is well suited to oilsands reservoirs such as those in Alberta and Saskatchewan, Canada. However, the process can be applied to any formations and situations where the target fractures are sought. The steps of the present method are generally illustrated in FIG. 4.

Figure 1A:
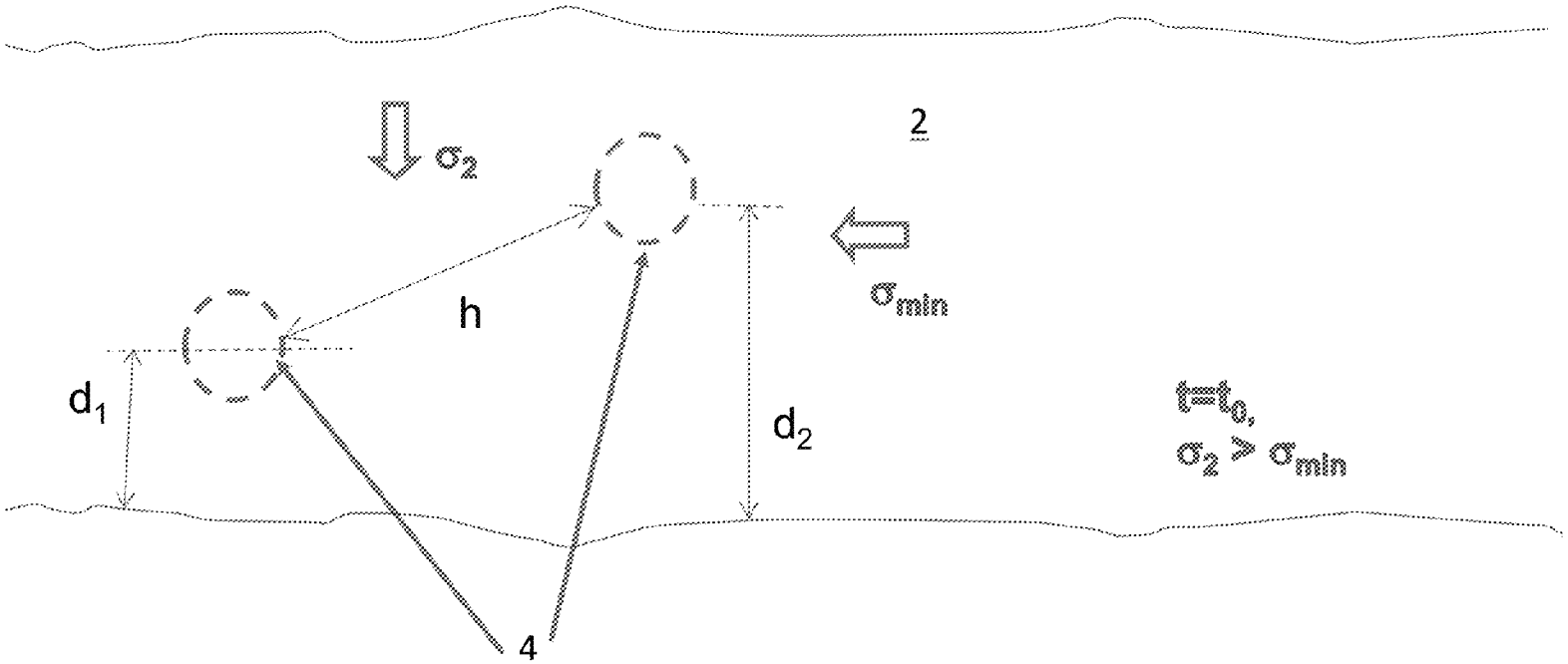
FIG. 1*a* illustrates a subterranean formation drilled with two wells of any inclinations in any azimuth with respect to the in-situ stress field.
Figure 1B:
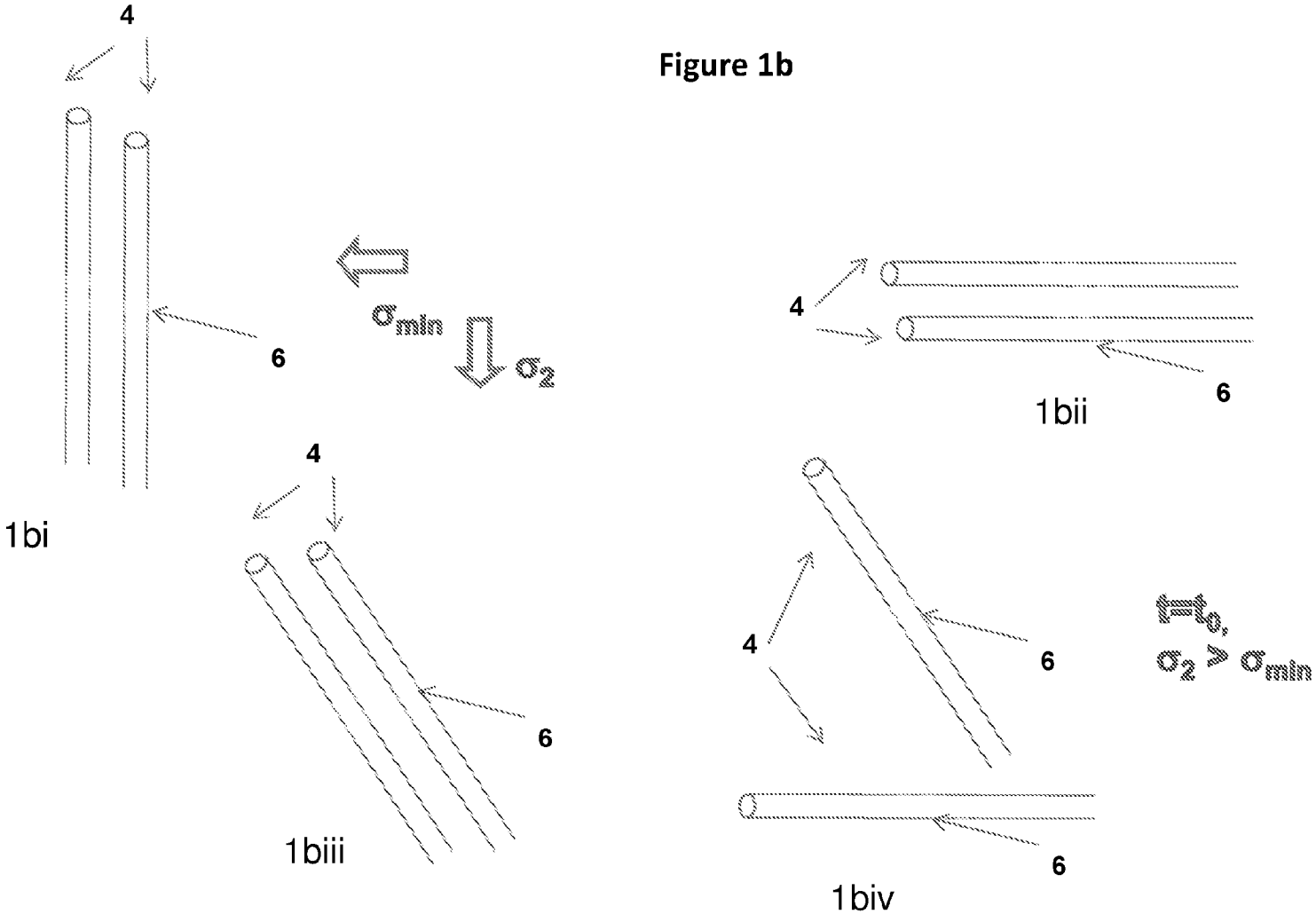
FIGS. 1*bi* to 1*biv* each illustrate alternate orientations for pairs of wells that can be drilled and completed for the purposes of the present invention.

Two wells are first drilled and completed. The well drilling and completion follows the conventional petroleum engineering practices or difference can be sought, all of which depends on the specific applications. FIG. 1*a* illustrates an example of well drilling applicable to the present invention although other methods and configurations of well drilling and completion would also be suitable for the present invention and would be obvious to a person of skill in the art. Some examples of further well orientations encompassed by the present invention are illustrated in FIGS. 1*bi* to 1*biv*.

An interval or zone 6 along each well is exposed along which injected fluid and thus pressure can enter into the target subterranean formation 2. The two wells 4 are preferably in proximal to one another and have respective contacts with the formation 2 to be fractured.

For the purposes of the present invention, well-formation contact describes an interval 6 where the fluid can be injected into the formation 2 from the well. For open holes, any section of the wells 4 that is segmented for accepting the injected fluid is the contact.

Figure 1D:
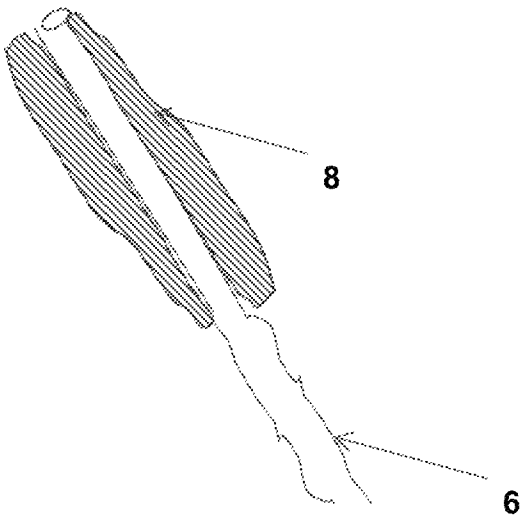
FIG. 1*d* illustrates a further well that has been drilled and completed according another embodiment of the present invention
Figure 1C:
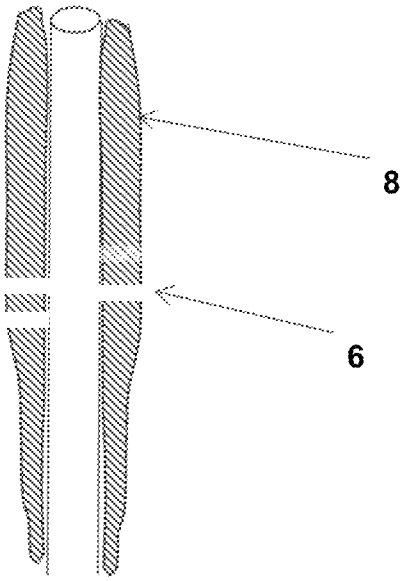
FIG. 1*c* illustrates a well that that has been drilled and completed according one embodiment of the present invention.
Figure 1E:
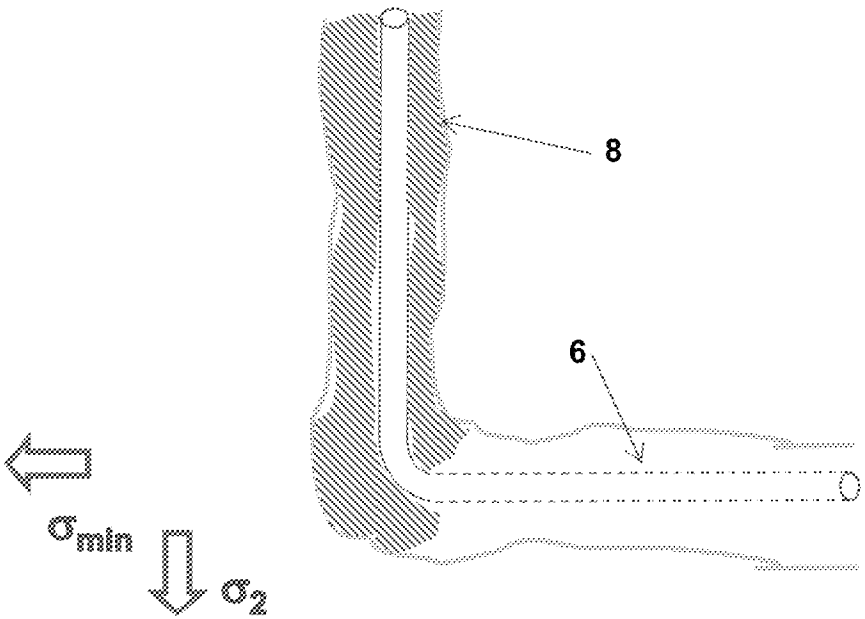
FIG. 1*e* illustrates a further well that has been drilled and completed according a further embodiment of the present invention.

The wells 4 may also be cased and cemented into place. The cement 8 is preferably perforated to penetrate the steel casing and the cement 8 to provide an interval 6 for the injected fluid to enter into the formation 2. The perforated interval 6 can be of any length and the fracture can be initiated anywhere along the contact length. This is illustrated in FIG. 1*c*. Alternatively, as illustrated in FIGS. 1*d* and 1*e*, a portion of the well can be cased and cemented 8 while another portion of well remains uncased, thus serving as the interval 6 through which injection fluid can enter the formation 2.

The two wells 4 can be combined in different ways. Preferably, as illustrated in FIGS. 1*bi* to 1*biv*, two injection intervals 6 are formed from each of said two wells 4. This allows exposed intervals 6 be close to each other so that pressure and/or temperature front can readily interact with each other.

Optimization of specific inter-well distance and/or orientation of their connection with respect to in-situ minimum stress component ($S_{min}$) depend on the in-situ condition, formation properties, operating condition, and production objectives among others. Simulations can be run to determine these well drilling and completion parameters for particular applications. For example, SAGD technology used in the in-situ oilsands development has the two horizontal wells 4 that are typically 5 m apart and 400 to 1000 m long which is open to the formation 2.

Figure 2A:
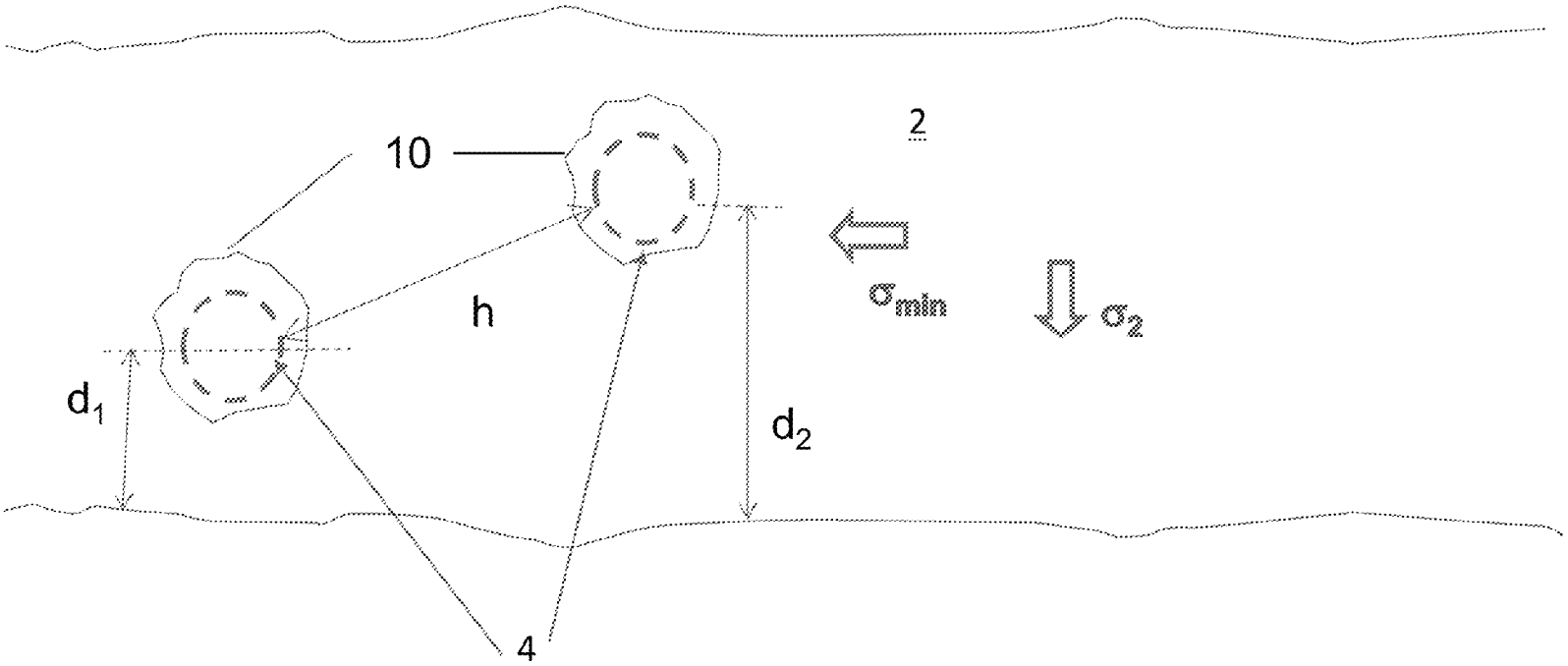
FIG. 2*a* illustrates a pair of wells as they are conditioned using a method of the present invention.
Figure 2B:
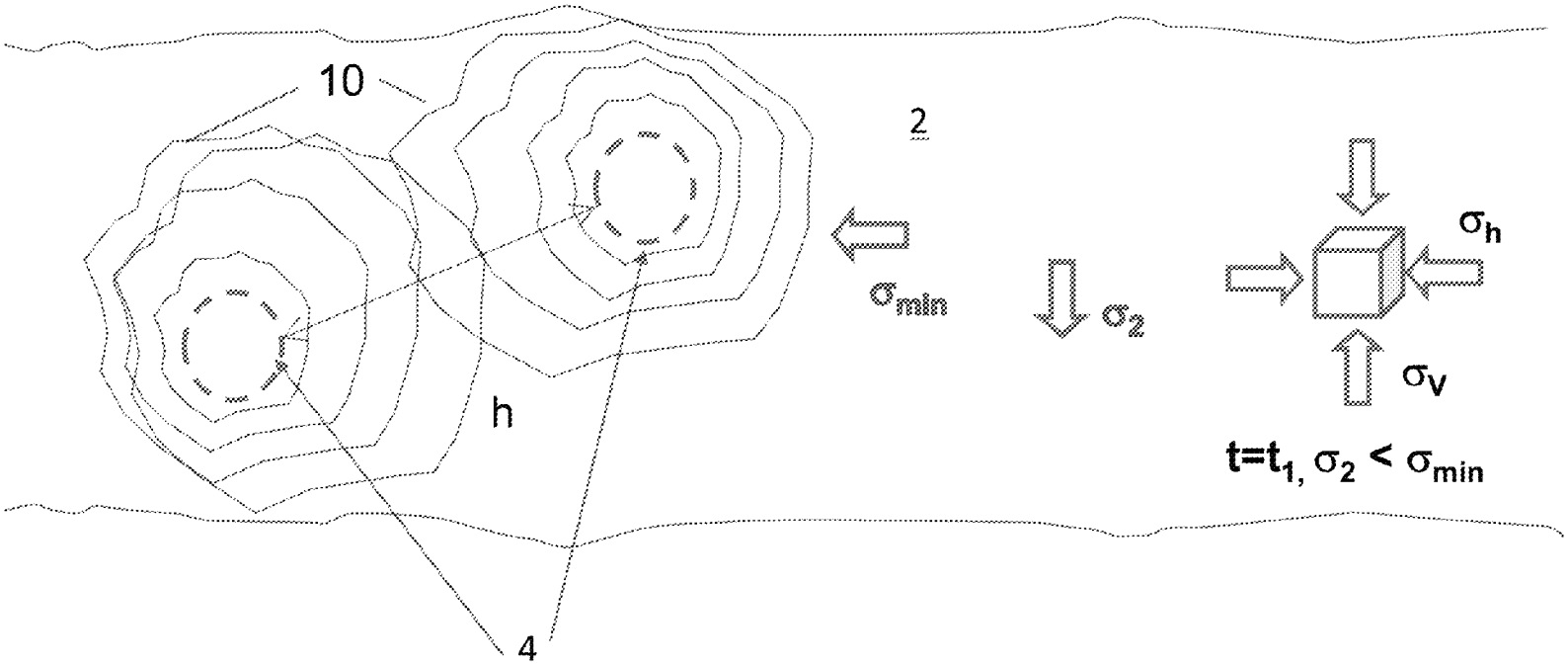
FIG. 2*b* illustrates a pair of wells as they are conditioned using a method of the present invention.

In a second step, the area where said two wells 4 to be connected via a fracture is conditioned via controlled injection into one or the two of said two wells 4. The increased pressure and/or temperature field alters the original in-situ stress condition via poroelastic and/or thermoelastic mechanisms. The new stress condition after the modification favors a fracture being formed to connect the exposed injection intervals 6 between said two wells 4. These steps are illustrated in FIGS. 2*a* and 2*b*. FIG. 2*a* illustrates the rather limited interaction between the two wells 4 at an early stage of conditioning and FIG. 2*b* illustrates the more developed interaction between the two wells 4 near the end of conditioning.

The stress modification step involves pressure diffusion fronts from each of the said two wells 4 interacting with one another. The faster the pressure and/or temperature diffusion, the earlier the stress condition is modified. The larger the pressure and/or temperature change, the more significantly the stress condition is modified. The pressure diffusion depends on the effective fluid mobility in the formation 2. Anything that can increase the mobility will help. Therefore, one or more of the following means can help the stress modification, although other means of stress modification are also possible and would be clearly understood by a person of skill in the art as being encompassed by the scope of the present invention:

(1) Dilation to increase the absolute permeability of the formation 2.

(2) Dilation with injected water to increase the relative permeability to water.

(3) Injection of warm water to reduce the fluid viscosity in the formation 2. Preferably, warm-up of the wells 4 via steam circulation prior to warm water injection can help to maintain the temperature of the injected warm water.

(4) Injection of chemical solvents or solutions to reduce the fluid viscosity in the formation 2.

(5) Injection or circulation of steam.

The pressure diffusion increases the pore pressure inside the formation 2, evoking the poroelastic stress buildup. Similarly, temperature diffusion increases the temperature inside the formation 2, evoking the thermostatic stress buildup. Both poroelastic and thermoelastic stresses are similar in their benefits for the dilation promotion purpose. However, in general, the temperature diffusion is slower than the pore pressure diffusion. Thus, injection at a higher pressure is more efficient than injection at a high temperature. Simultaneous high pressure and high temperature injection is most preferred for the purposes of the present invention. For the purposes of the present invention, the phrase "high-pressure injection" is used and it should be understood that this phrase includes or applies to high-temperature injection as well.

Figure 3A:
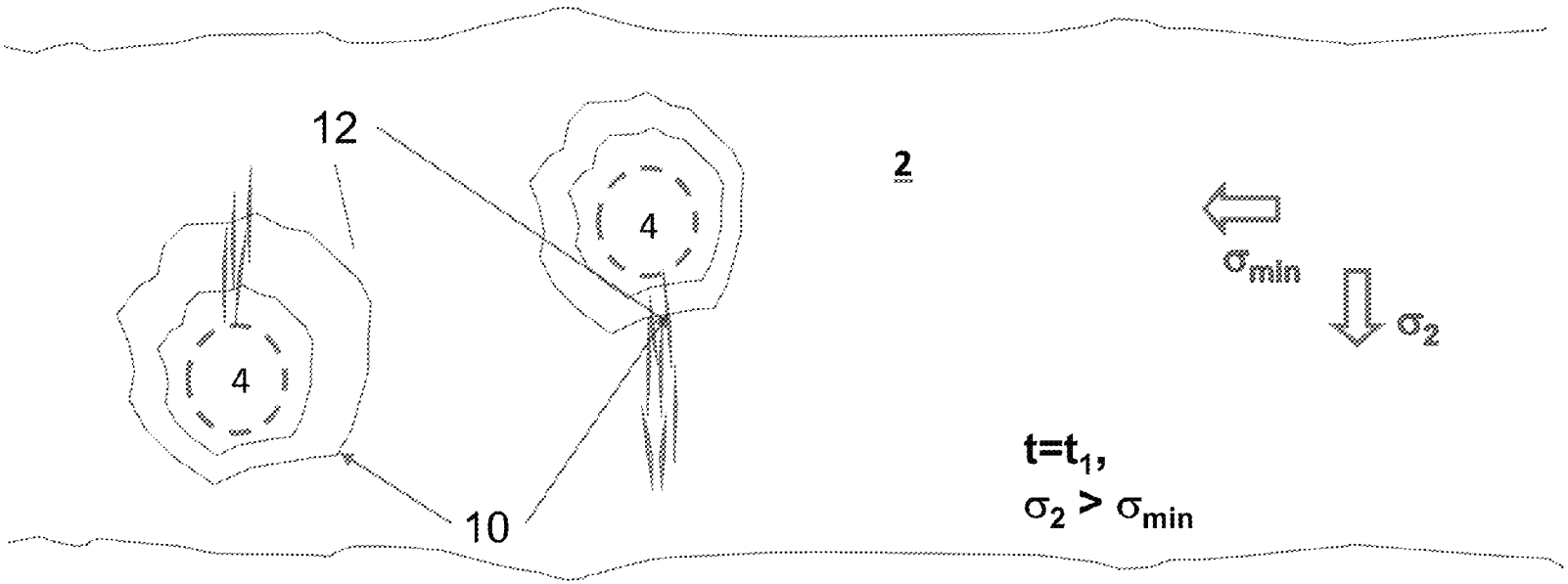
FIG. 3*a* illustrates a fracture zone in a subterranean formation as a result of a typical method of fracturing.

The injection pressure should start below the original in-situ minimum stress ($S_{min0}$). Preferably, known methods can be used, such as performing a mini-frac test to measure the original in-situ minimum stress. As the pore pressure increases in the formation 2, the in-situ stresses increase due to the poroelastic mechanism. Thus, after the injection has undertaken for a certain period of time, it is possible to increase the injection pressure to somewhat above $S_{min0}$. Such an increased injection pressure will increase the magnitude of the stress modification. The increase is preferably gradual and monitored to prevent formation of a macroscopic tensile fracture before the formation 2 is fully conditioned. As illustrated in FIG. 3*a*, if a fracture is initiated prior to full development of an interaction between two neighboring wells 4, the fractures are not successful in connecting the two wells 4.

Between the two wells 4, many alterations can be pursued in the injection pressure, injection rates, injected materials and so on. Most preferably, injections are conducted in both wells 4 simultaneously to aid in accelerating interaction of the pressure diffusion between the wells 4.

In other circumstances, injection into a single well may be preferred. For example, if a bottom layer of water is present in the reservoir, it may beneficial to reduce or eliminate injection into a lower of said wells 4 to avoid communication with the bottom water, although full elimination of injecting into the lower well is not necessarily required even in the presence of the bottom water layer.

In one preferred embodiment, a lower well injected or circulated with steam, to aid in viscosity reduction in an upwards direction, due to the tendency of steam to rise. A upper well can then be injected with a solvent or chemical solution, to promote viscosity reduction in a downwards direction, via gravity-driven fluid movement downwards.

In another embodiment, the injection can start with water such as water produced from water treatment plants typically in the vicinity of the wellbore operations. As dilation of the formation 2 induces more pore space, the injection material can be switched to steam or solvent that will have a good injectivity due to the pre-dilation by water. Advantageously in this arrangement, pore space is increased using more abundantly available water and more expensive steam or solvent is used to promote dilation and diffusion.

Furthermore, the temporal alterations described above can vary between said two wells 4. In all cases, the materials, pressures, temperatures and rates of injection and injection coordination between the two wells 4 depend on specific geological situations, convenience and economics. Geomechanical simulations based on the specific circumstances can decide the optimum strategy.

Some examples of conditioning means include substantially simultaneous injection of stimulant into both wells 4 or substantially alternating injection of stimulant into one and then another of the well pair. Stimulant injection during the conditioning phase are preferably monitored and controlled to either maintain a constant injection rate and/or pressure or to vary the injection rate and/or pressure. Injection pressure can, in one embodiment of the present invention, be incrementally increased, or alternatively be raised and lowered to achieve formation 2 conditioning. Furthermore, the injection rate or injection pressure during conditioning can vary between the two wells 4.

Stimulant injection rates should be lower than that required to fracture the formation 2, but sufficiently high to create a desired rate of pressure increase. Preferably the injection rate is optimized to shorten operation time of the whole process.

Stimulant injection rate and time can be determined on-site based on the real-time monitored well injection pressure and rate. If the pressure increase is too slow, the rate can be increased. If the pressure rises too fast, the rate should be reduced. Site-based real-time pressure monitoring methods and devices are well known in the art and are included in the scope of the present invention. Preferably, stimulant injection rates are initially slower to probe and assess characteristics of the formation 2, before a higher rate is used.

In some well completions, a well has two or more fluid injection or production points. For example, in SAGD operations, a long horizontal well interval is completed with two or more concentric tubulars. One leads to the front end, or toe, of the horizontal well and the others are placed to the intermittent points behind the toe one of which may be placed at the heel of the horizontal well. In these situations, the injection can proceed with injecting into one end such as toe while producing from the other end such as heel. The produced rate is smaller than the injected so that a net injection occurs into the formation. One advantage of such an injection scheme is to promote uniform distribution of pressure or temperature along the well length. Another advantage is an easy control on the injection rate or pressure.

The stimulant material to be injected can vary, so long as it serves to raise formation pressure and it does not harm the hydraulic conductivity of the formation 2 being fractured, any material can be injected. Ease to operate and economics dictates the material. For the purposes of the present invention, stimulant includes water of any temperatures, steam, solvent, solutions of suitable chemicals or their mixture in any portion.

Stimulant materials being injected into each of the two wells 4 can be different between them and/or alter over time. Furthermore, stimulant type and temperature to be injected during the stress modification phase can vary between the two wells 4. For example, cold or warm water may be injected into a first well while the second well may be injected with steam. Alternatively a solvent, either warm or cold, may be injected in a first well, while the second well may be injected with steam. A skilled person in the art would understand that other combinations of stimulant type, temperature and pressure are also possible and encompassed by the scope of the present invention.

Some stimulant materials can increase the pressure diffusion and thus, should be encouraged. For example, in heavy oil or oilsands industry, solvent or certain chemical solutions can reduce the oil viscosity and thus increase the effective formation mobility. Warm water up to steam can reduce the viscosity and thus helps the stress modification.

Stimulants used for injection are not limited and can be anything from water produced from nearby water treatment facilities to high-temperature steam or anything between. The stimulant viscosity can also range from approximately 1 centipoise (cp), as in the case of water, to high-viscosity stimulants. Specific values of the viscosity can be designed by simulations when the in-situ condition and formation properties are known.

The stress modification stage serves to modify the in-situ stress field around the two wells 4 so that the target fracture can be formed along the connection of the said two horizontal wells 4. The timing of the stress modification phase depends on the in-situ conditions, formation properties, stimulant material properties and injection conditions including rate, pressure and temperature of injection, and combinations of these conditions and properties. Preferably, geo-mechanical simulations can be run prior to conducting the methods of the present invention to estimate the conditioning timing and design the injection pressure or other condition. Further preferably, field pilot tests can be run in a particular location to fine-tune the timing. Moreover, end of the stress modification stage can be determined by pressure interference tests. Conventional interference test protocols in transient pressure analysis of petroleum engineering can be used. For example, one of the well pair is shut-in while the other well continues the injection. If the shut-in well sees pressure impact of certain degree from the injection well, the current dilation stage can end and the subsequent dilation promotion stage follows.

Following stress modification, the injection pressure is increased further at one or the two of said two wells 4 to break down the formation 2 and to propagate the fracture zone 12 which will connect the two wells 4. This step is called fracture communication stage and is illustrated in FIG. 3*b*.

Figure 3B:
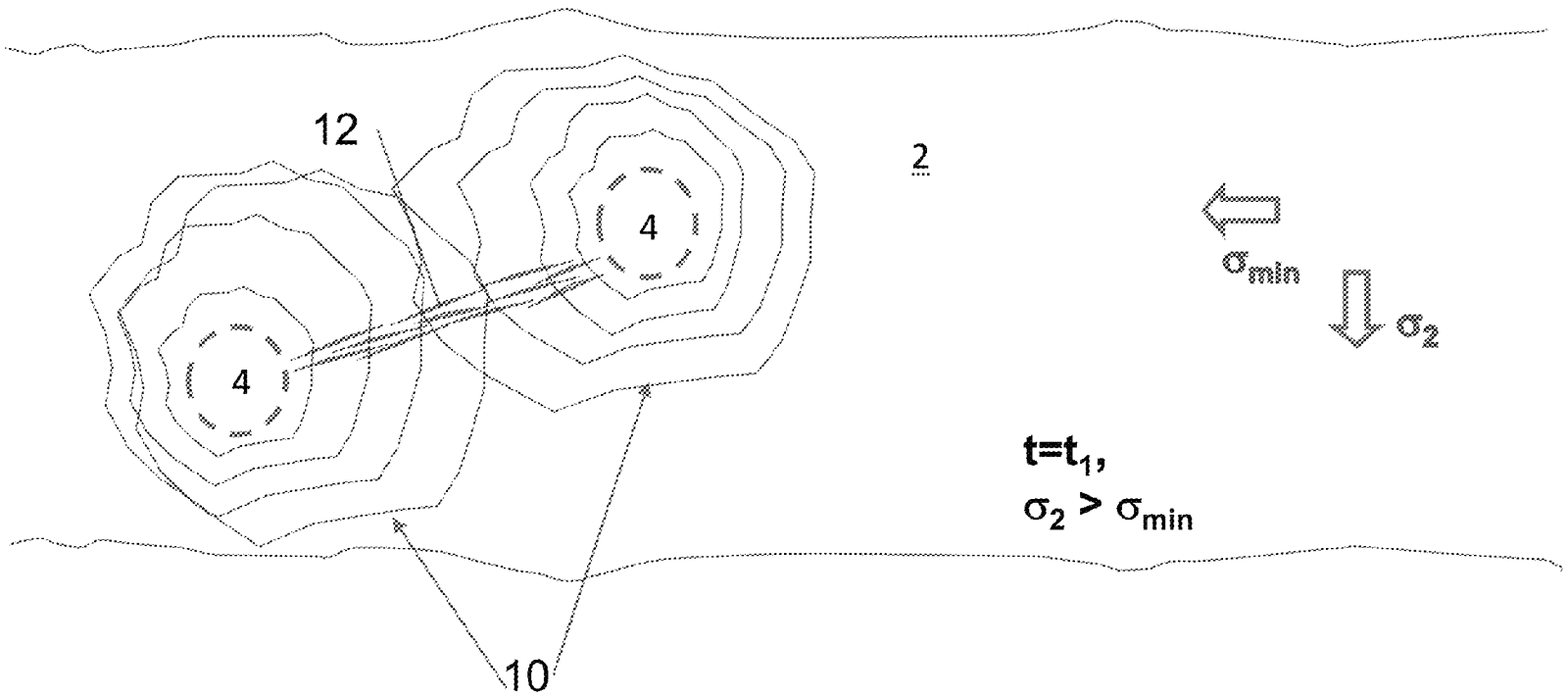
FIG. 3*b* illustrates a fracture zone in a subterranean formation as a result of the method of the present invention.

In both FIGS. 3*a* and 3*b* it should be noted that compressive forces within the formation are represented as a positive increase in stress. While this may differ from typical solid mechanics notation, representing compression as a positive force is common in geomechanics, and is the correlation used for the purposes of the present invention.

For example, when the present method is applied to start up the SAGD process, injection of the stimulant serves to stimulate the area around the SAGD well pair so that a fracture zone 12 is formed between them.

In another example application, grout may need to be placed to seal a certain interval in the subsurface formation 2. In this case, the fracture is first formed along the certain interval and then grout is injected into the fracture. In yet another example application, contaminants may need to be removed from subsurface. Leaching is normally used. The target fracture can be formed first to start the leaching process at the target locations. In a final example, THAI process has been tried as a potential in-situ oilsands recovery process. A target fracture can be formed between the injection well and producer well.

In geothermal applications, two wells are drilled with one well injecting cold water and the other producing the heated water. The present invention can be used to form a fracture between the wells.

The injection pressure is increased by increasing either the injection rate or injection pressure above the original in-situ minimum stress, $S_{min}$, until a fracture zone is initiated. Initiation of the fracture zone can be observed by monitoring the injection pressure and/or rate. If fracturing injection is maintained at a constant rate, the increased injectivity is reflected by a decreasing pressure. If fracturing injection is maintained at a constant pressure, the increased injectivity is reflected by an increased demand of more volume per unit time to be injected in order to maintain the constant pressure. During initiation of the fracture, injection can be carried out at one or both of the two wells 4.

Preferably, once the fracture has been initiated, one well is shut-in while the other well continues the injection. This enables detection of the inter-well communication. When pressure at the shut-in well increases, it means that the two wells 4 are in communication with each other.

The present method utilizes poroelastic and/or thermoelastic mechanisms to alter the original un-disturbed in-situ stress conditions so that the target fracture can be created. Poroelastic stress comes from the interaction between pore pressure and solid deformation. The general theory of poroelasticity was established by Biot (1941) although the particular case of poroelasticity relating to interaction between deformation and pressure diffusion was studied earlier by Terzaghi (1923) for soils. Poroelastic effects in rock mechanics related to petroleum engineering were first noted by Geertsma (1957, 1966). Thermoelastic stress comes from the interaction between temperature and solid deformation. Physically, an increase in the pore pressure (p) or temperature (T) causes rock to expand. Such expansion is constrained by the material outside the domain of p/T increase. The restriction introduces an additional stress component to the original undisturbed in-situ stress field in the formation 2. Such induced stresses are called the poroelastic or thermoelastic stresses depending on if the causing mechanism is pore pressure increase or temperature increase.

Mathematically, the stress modification phase and subsequent fracture initiation and propagation stage can be simulated by a nonlinear coupled thermo-hydro-mechanical model.

This detailed description of the present processes and methods is used to illustrate certain embodiments of the present invention. It will be apparent to a person skilled in the art that various modifications can be made and various alternate embodiments can be utilized without departing from the scope of the present application, which is limited only by the appended claims.

The invention claimed is:

1. A method of creating one or more targeted fractures in a subterranean formation, said method comprising the steps of:

a. drilling and completing two wells in the formation;

b. conditioning said wells by injecting stimulant into the said wells at an injection rate lower than that required to induce a fracture in the formation to create a stress condition favorable for forming a fracture zone connecting said two wells; and c. initiating and propagating the fracture zone in said formation;

wherein the stimulant is injected at an injection pressure that is below the original in-situ minimum stress of the formation during a first stage of conditioning and wherein injection pressure is raised above the original in-situ minimum stress during a second stage of conditioning.

2. The method of claim 1, wherein the two wells are proximal to one another and offset to each other.

3. The method of claim 1, wherein the wells are open hole wells.

4. The method of claim 1 wherein at least a portion of the wells are cased wells.

5. The method of claim 4, wherein at least a portion of the wells are cemented in place.

6. The method of claim 5, wherein the cement is perforated to provide contact between the wells and the formation to be fractured.

7. The method of claim 5, wherein a first portion of each of the well is cased and cemented and a second portion of wells are uncased and uncemented, said second portion providing contact with the formation to be fractured.

8. The method of claim 4, wherein each of the two wells comprises a perforation interval along at least a portion of each well that provides contact with the formation to be fractured.

9. The method of claim 8, wherein the perforation intervals of each of said two wells are proximal to one another to allow the wells to interact with each other.

10. The method of claim 9, wherein the two wells are drilled as horizontal, open wells in a Steam Assisted Gravity Drain (SAGD) process.

11. The method of claim 1, wherein at least a portion of each of the two wells are in contact with the formation to be fractured.

12. The method of claim 1, wherein conditioning the wells serves to alter pore conditions selected from the group consisting of pore pressure and pore temperature in the formation around the two wells.

13. The method of claim 12, wherein conditioning the wells serves to alter original in-situ stress fields in the formation via mechanisms selected from the group consisting of poroelasticity and thermoelasticity.

14. The method of claim 1, wherein the stimulant is injected simultaneously into both wells.

15. The method of claim 1, wherein the stimulant is injected alternately into the first and then the second well of the two wells.

16. The method of claim 1, wherein the stimulant is injected at a constant injection rate.

17. The method of claim 1, wherein the stimulant is injected at a varying injection rate.

18. The method of claim 17, wherein stimulant injection rate is incrementally increased.

19. The method of claim 17, wherein stimulant injection rate is raised and lowered to achieve formation conditioning.

20. The method of claim 1, wherein stimulant injection rate or stimulant injection pressure during conditioning varies between the two wells.

21. The method of claim 1, wherein the stimulant is one or more materials selected from the group consisting of water, steam, solvents, solutions of suitable chemicals and mixtures thereof.

22. The method of claim 21, wherein the stimulant has a viscosity of at least 1 cp.

23. The method of claim 21, wherein stimulant type and stimulant temperature vary between the two wells.

24. The method of claim 1, wherein initiating the fracture zone comprises injecting the stimulant at an injection pressure greater than that required for conditioning.

25. The method of claim 24, wherein injection of the stimulant is applied to one of said two wells.

26. The method of claim 24, wherein injection of the stimulant serves to stimulate the formation around the two wells so that the fracture zone forms between the two wells.

27. The method of claim 24, wherein the injection pressure is increased above an original in-situ minimum stress of the formation by increasing injection rate.

28. The method of claim 27, wherein the initiation of the fracture zone is monitored by monitoring injection pressure.

29. The method of claim 27, wherein the initiation of the fracture zone is monitored by monitoring injection rate.

30. The method of claim 24, comprising shutting-in a first of the two wells and continuing injection in a second of the two wells once a fracture zone is initiated.

* * * * *